US005175890A

United States Patent [19]

Ruth

[11] Patent Number: 5,175,890

[45] Date of Patent: Jan. 5, 1993

[54] APPARATUS AND METHOD FOR SANITIZING TOILET SEATS

[76] Inventor: Solomon J. Ruth, 15103 Qual Rock Cr., Houston, Tex. 77095

[21] Appl. No.: 698,451

[22] Filed: May 10, 1991

[51] Int. Cl.[5] ..... E03D 9/00

[52] U.S. Cl. ..... 4/233; 4/222

[58] Field of Search ..... 4/222, 233, 300.2, 443, 4/447, 448, 420.4, 420.1, 223

[56] References Cited

U.S. PATENT DOCUMENTS 3,171,135 11/1962 Polichio ..... 4/222 X 3,199,739 10/1964 Corning et al. ..... 4/223 X

FOREIGN PATENT DOCUMENTS 3101761 8/1982 Fed. Rep. of Germany ..... 4/420.4

1053053 1/1954 France ..... 4/615

*Primary Examiner*—Henry J. Recla

*Assistant Examiner*—Thomas J. Sweet

*Attorney, Agent, or Firm*—Robert Shaddox

[57] ABSTRACT

A transportable sanitizing device is equipped with a liquid dispenser, tissue dispenser and spray gun, generally. The sanitizing device is initiated by removal of the spray gun and dispersement of disinfectant about the perimeter of a toilet seat followed by the application of tissue about the same perimeter removing the disinfectant.

2 Claims, 8 Drawing Sheets

APPARATUS AND METHOD FOR SANITIZING TOILET SEATS

BACKGROUND OF THE INVENTION

This invention relates to the method and apparatus for sanitizing toilet seats. Generally, the apparatus is such that it is capable of being installed either adjacent to the toilet on a fixed surface or on the tank of the commode or toilet. The enables this apparatus to be placed in temporary or portable toilets, such as the type housed in temporary housings at construction sites, or on stationary non-mobile toilets.

Traditionally, there has been general public concern regarding the sanitization of public and private toilet seats and surrounding apertures. The prior art discloses a reception to this problem through the often highly technical apparatuses employed for the simple purpose of disinfecting toilet seats. Disclosures of these types are found in U.S. Pat. Nos. 4,790,039; 4,924,532; 3,599,246; 4,790,036; 3,815,158; 3,988,788; 3,837,018; 4,03,316; 4,183,105; 4,536,899; 4,242,764; 4,873,739; 4,734,942; 4,745,639; 4,729,133; 4,873,728; 4,769,859; 4,910,815; 4,766,617; 4,566,648; 4,412,360; and, 4,806,406.

For reasons unknown, many of these devices have not been publicly implemented, perhaps due to the cost ineffectiveness and lack of practicalities in the use of these devices.

Generally, the prior art of record relates to highly technical and mechanical apparatuses that would not and could not be used for applications in other than a single stationary toilet. Further, the prior art of record demonstrates the need for the construction of, and adaptation of sanitizing devices to the toilet seat base and tank such that the sanitizing devices could be easily transferred. Thus, one object of the present invention avails the sanitizing device to be attached and used to either the toilet tank or adjacent wall and could be transferred from facility to facility.

More specifically, U.S. Pat. Nos. 4,873,728 and 4,790,039 demonstrate a transferable sanitizing device which may be implemented on various toilets, stationary or non-stationary. However, the primary embodiment of the present invention demonstrates simplicity in design and function over prior art patents and is more cost effective and easier to use. Additionally, the present invention demonstrates a method of removal of the sanitizing liquid from the surface perimeter of the toilet seat which is not disclosed or suggested by the U.S. Pat. No. 4,790,039 . Also, an object of the present invention discloses a more sanitary condition than the U.S. Pat. No. 4,873,728 , which houses the disinfectant and sanitizing wipe in the same container, resulting in unsanitary conditions within the container unless the dispensing tissue is removed after each use. The prior art thus demonstrates the need for a modular transferable sanitizing device for toilets that is cost effective and more sanitary in its use, such as Applicant's invention. Other objects and advantages of this invention will become more fully apparent below, reference being made to the accompanying drawing and appended claims.

DETAILED DESCRIPTION OF THE PREFERRED EMBODIMENT

Figure 1:
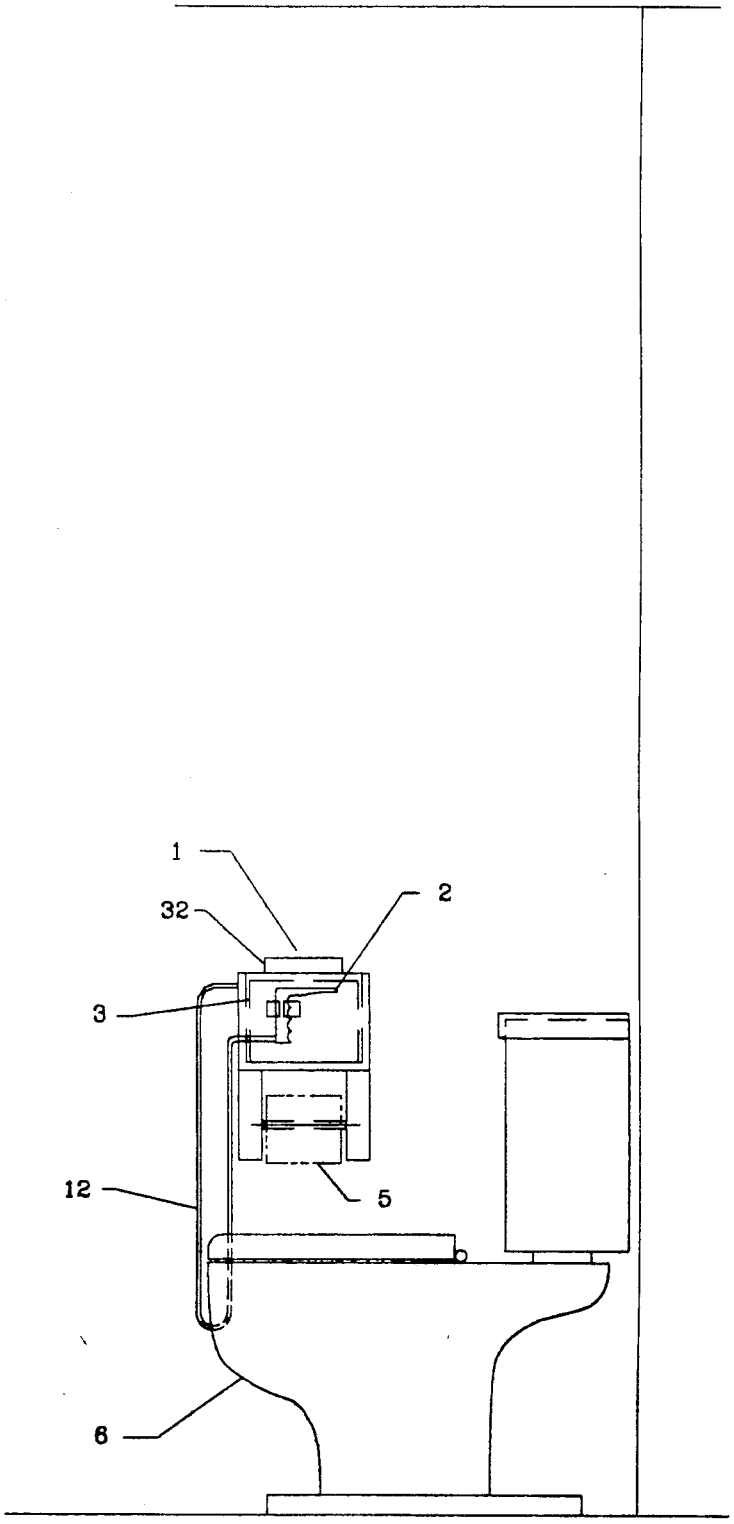
FIG. 1 is a front elevational view demonstrating one embodiment of the sanitizing device.

Referring now to the drawings of FIG. 1, there is illustrated a toilet 6 and sanitizing device 1 which houses and holds the disinfectant spray gun 2, sanitizing liquid dispenser 3, sanitizing liquid exchanger hose 12, and disinfectant tissue roll 5.

Figure 2:
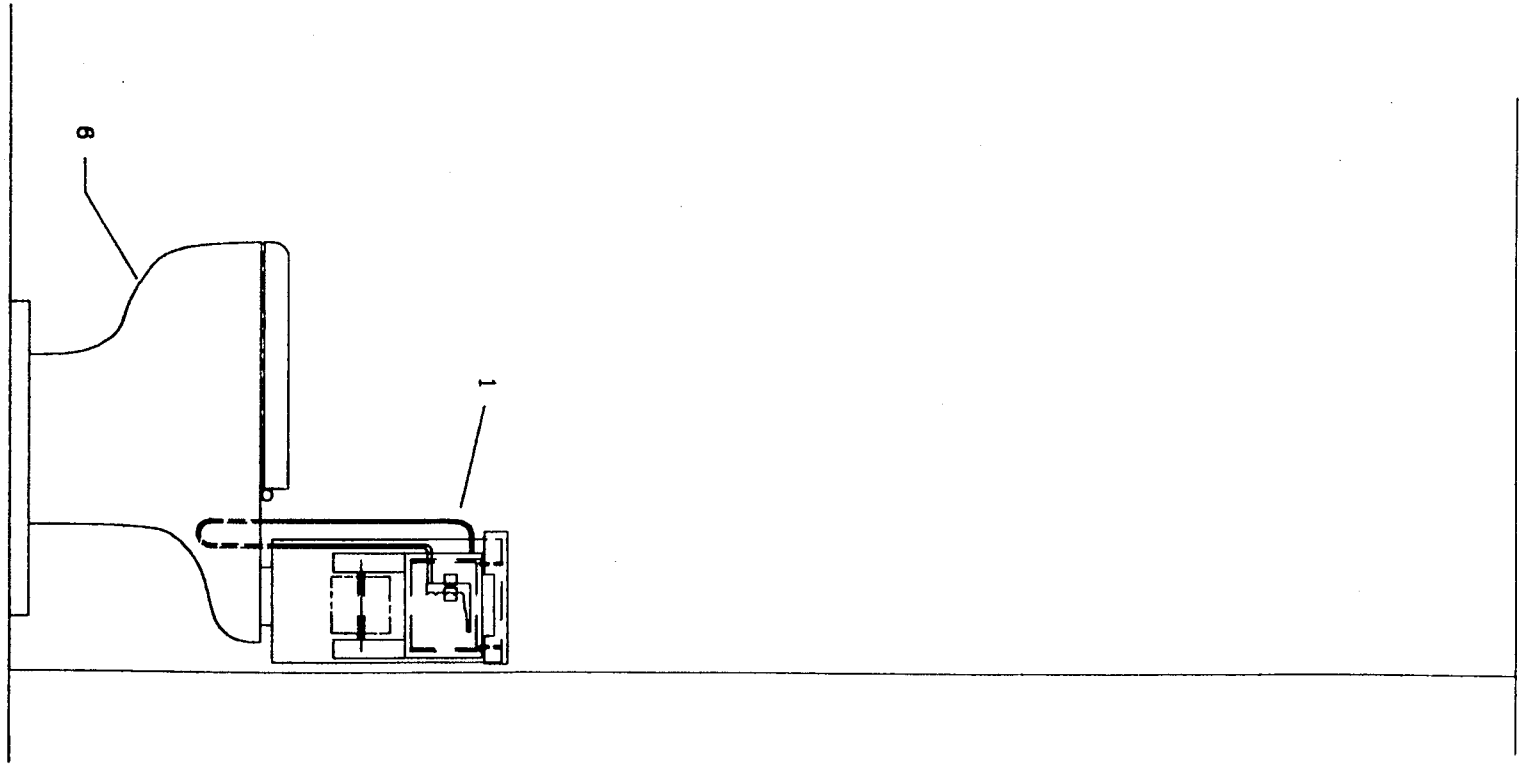
FIG. 2 is a front elevational view demonstrating an alternative embodiment of the sanitizing device.
Figure 3:
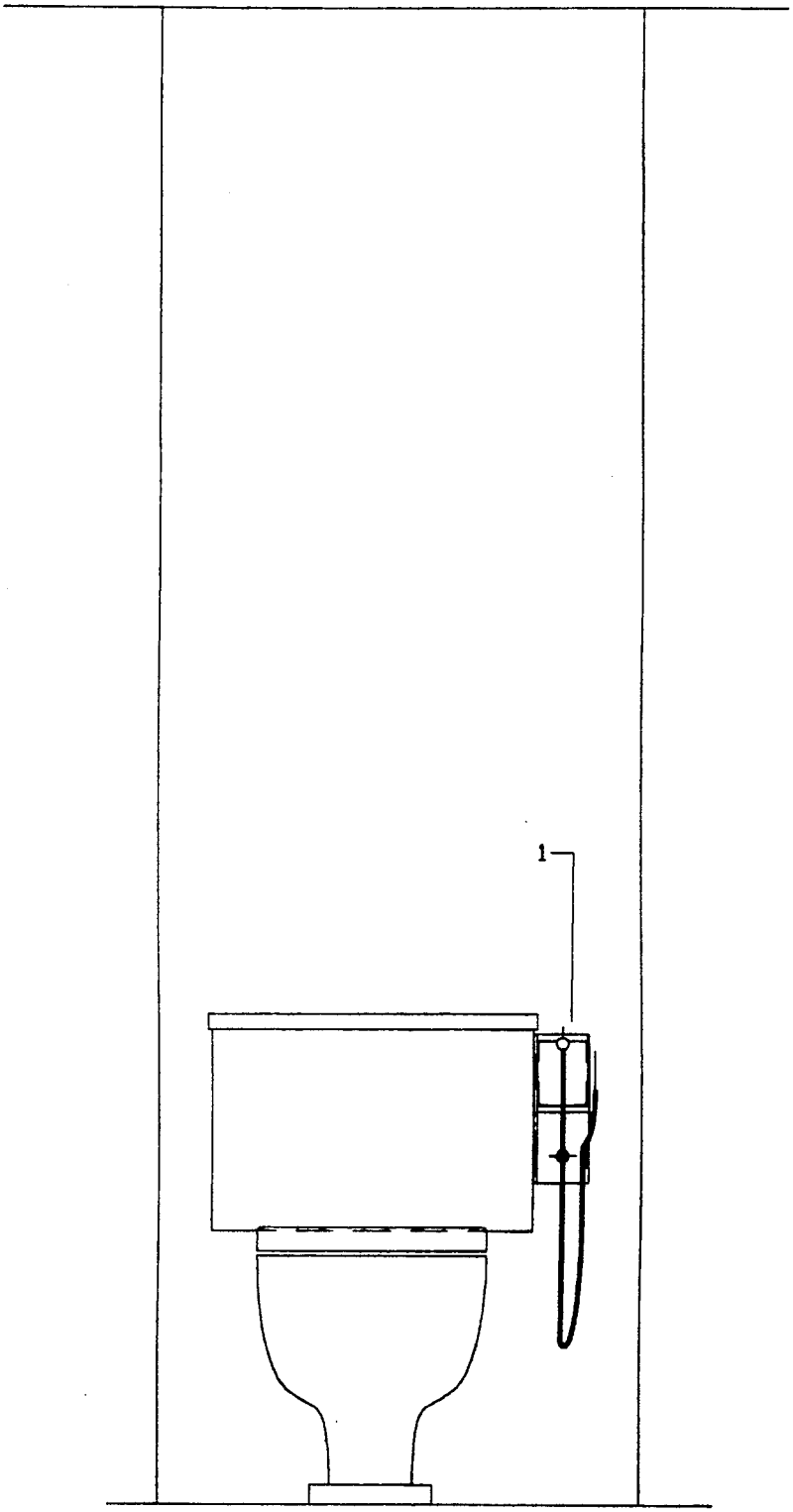
FIG. 3 is a side view of the sanitizing device.

FIG. 2 demonstrates an alternative embodiment of the present invention attached to the toilet 6 at 1.

Figure 4:
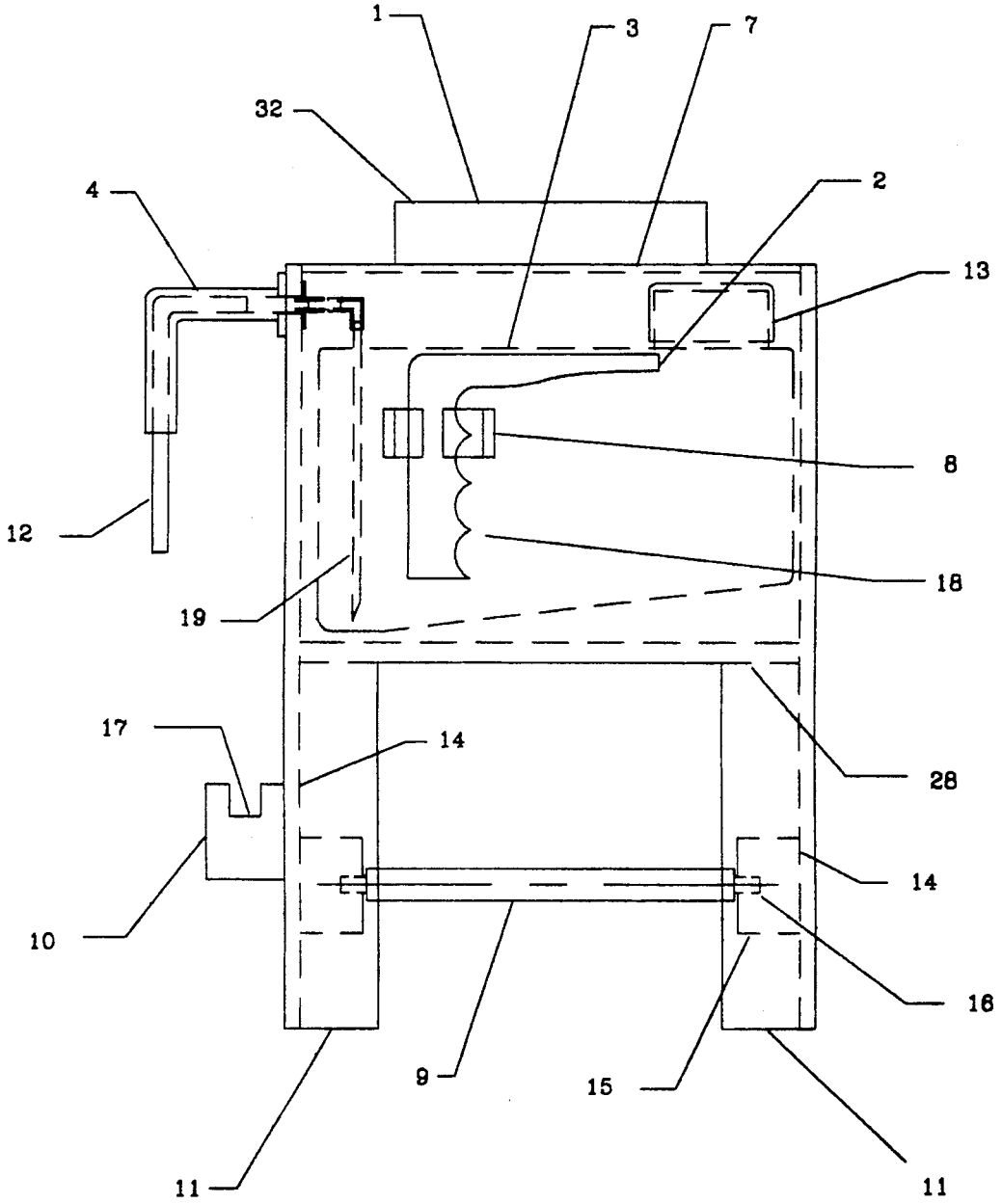
FIG. 4 is a front elevational cut-away of the sanitizing device.

FIG. 4 demonstrates the sanitizing device comprising a liquid dispenser housing 7 and liquid dispenser 3 enclosed by liquid dispensing cap 13. The liquid dispenser 3 contains a bracket 8 longitudinally placed on the side of the liquid dispenser 3, capable of securing and fastening the liquid dispensing spray gun 2. The liquid dispensing spray gun 2 contains a handle 18 which at its lower most end is connected a hose 12 (connection not pictured). The liquid dispensing hose 12 is insulated by insulation means 4 which may be made of any common rubber insulation. A tube 19 leads into the liquid dispenser 3 in order to enable the transfer of sanitizing liquid from the liquid dispenser 3 to 2, spray gun nozzle. At the lower most end of the sanitizing device 28 is a housing for the tissue dispenser which is enclosed by walls 11 and 14. The tissue dispenser housing comprises a roller 9 connected at 16 to support 15 which is attached to wall 14. Hose 12 may be secured and fastened by bracket 10 at groove 17.

Figure 5:
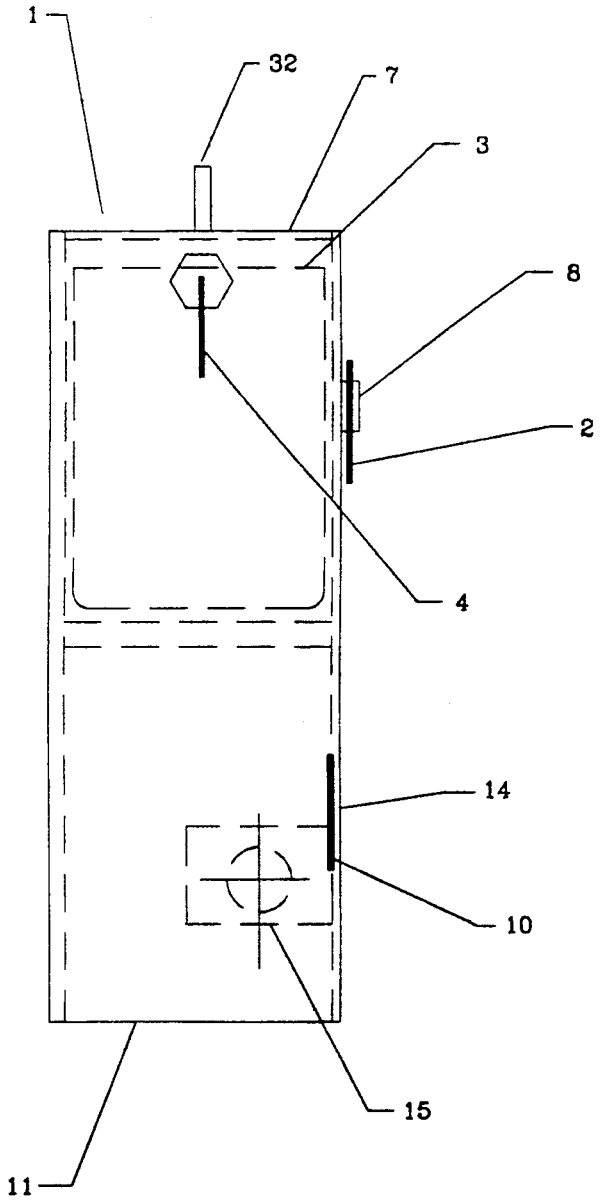
FIG. 5 is a side elevational cut away of the sanitizing device.

FIG. 5 demonstrates a side elevational cut-away of the sanitizing device 1 with lid 33 opening into housing 7 for the liquid dispenser 3. A liquid dispensing hose 4 may be adjustably and securely connected at bracket 10. Attached to the liquid dispenser housing 7 is an exterior bracket 8 for holding dispensing spray gun 2. Lower housing 14 contains a lower most housing 11 and tissue dispensing and support 15.

Figure 6:
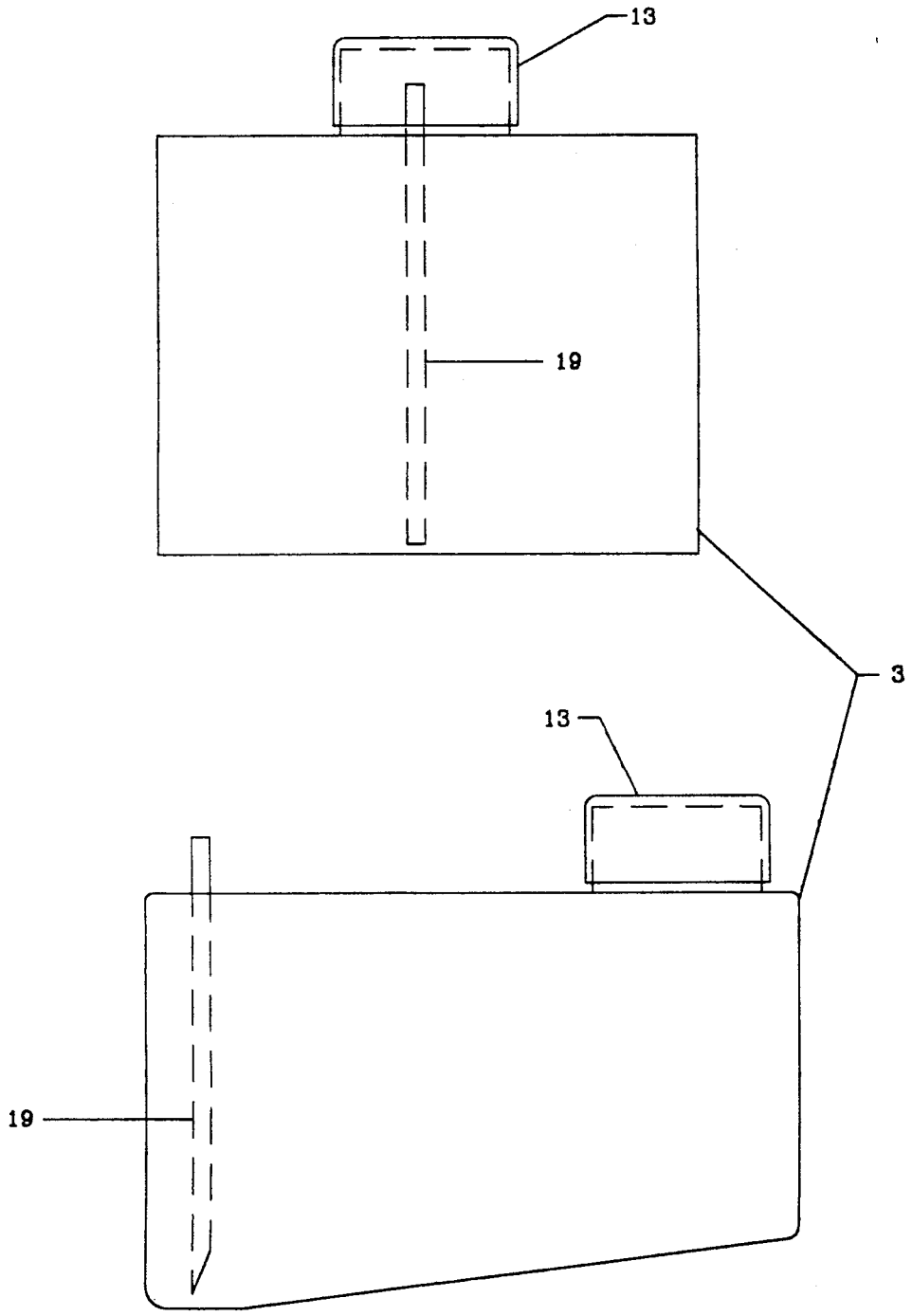
FIG. 6 is a front and side cut-away of the liquid dispenser.

Referring now to FIG. 6, a front and side elevational of the liquid dispenser 3 is pictured containing cap 13 and tube 19 used to transfer the sanitizing liquid from the liquid dispenser 3 into hose 4.

Figure 7:
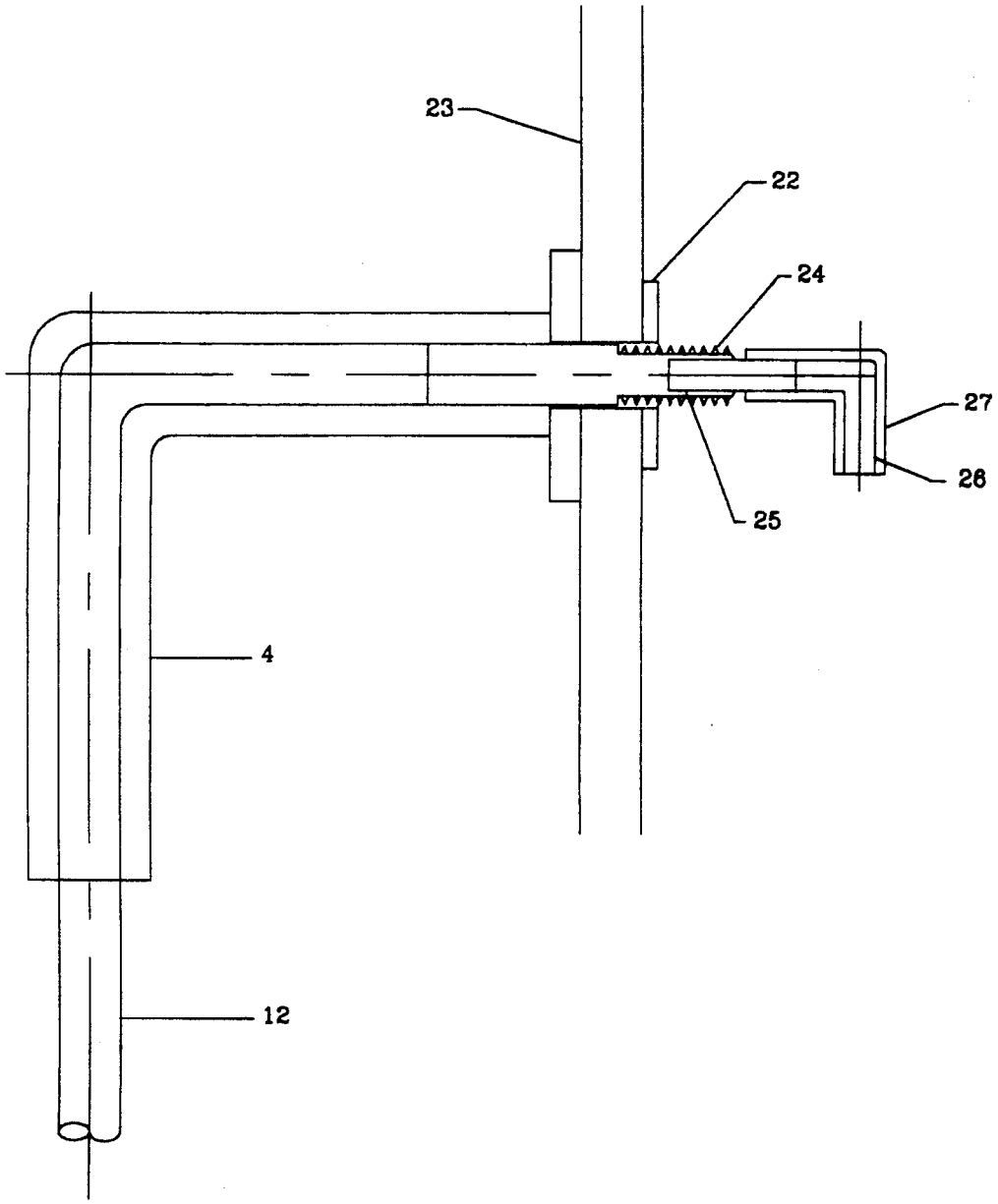
FIG. 7 is a side cut-away of the dispensing hose.

FIG. 7 is an elevational cut-away of the liquid dispenser 3 which comprises a side wall housing 23, insulating hose 4 extending horizontally therefrom and connected at 22 to hose 4, and tube 12 extending into the liquid dispenser 3 at 24. Connection means 26 is used to join tube 19 and tube 12, and is insulated by insulation means 27 wherein the connection means 26 terminates at 25 leading into a securing means 24, used to secure the insulating and tube means at 22.

Figure 8:
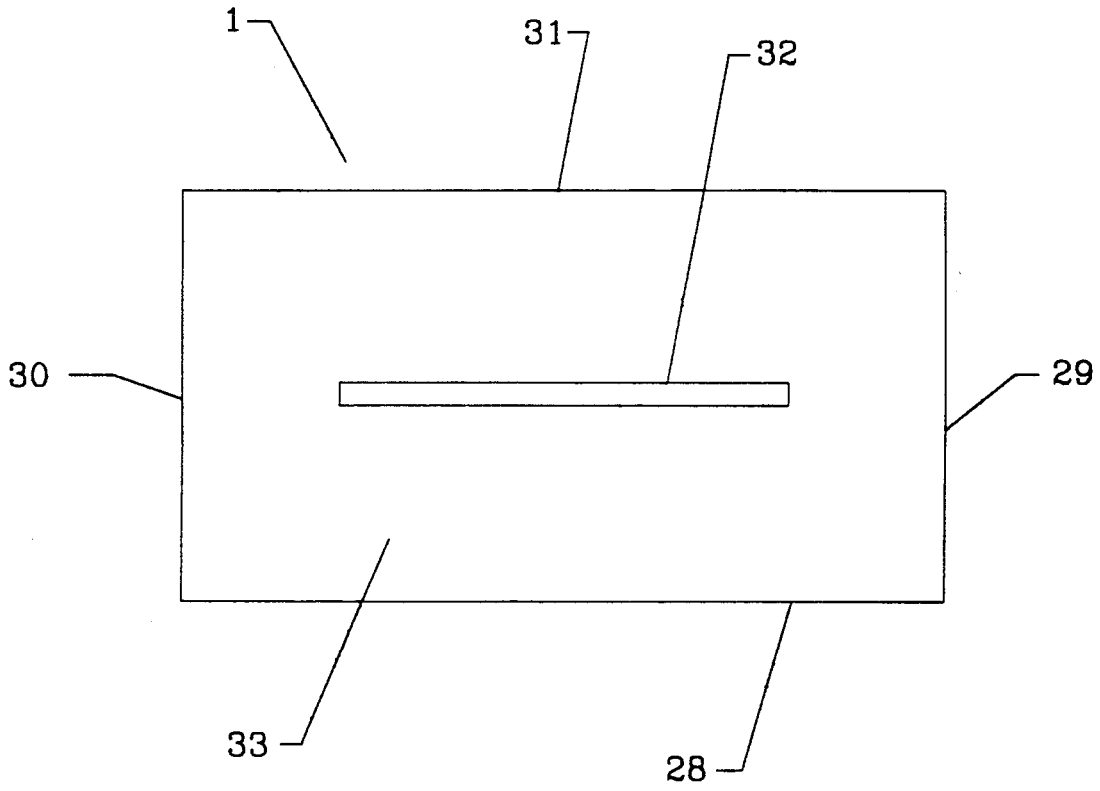
FIG. 8 is a top view of the sanitizing device.

Referring now to FIG. 8, a top view of the liquid sanitizing device 1 demonstrates the perimeter boundaries 28, 29, 30 and 31 of the sanitizing device 1 which is removable allowing entrance and replacement of liquid dispenser 3 by handle 32 to remove the lid.

Since many possible embodiments may be made of the invention without departing from the scope thereof, it is to be understood that all matters herein set forth or shown in the accompanying are to be interpreted as illustrative and not in a limiting sense per view of the invention as specified in the appended claims.

What is claimed is:

1. A toilet seat sanitizing device and mounting comprising:

(a) a housing adapted to be mounted on a wall, said housing comprising two side walls, a floor, a back wall, a front wall and a removable cover wherein said two side walls of said housing extend below said floor of said housing wherein said extending two side walls are provided with means on the extended portion below said floor of said housing for mounting tissue dispensing means and wherein said housing is provided with a housing aperture through one of said side walls;

(b) a liquid container provided with a first aperture and a cover adapted for combination and sealing engagement with said container, wherein said container and cover combination is provided with a second aperture and wherein said container and cover is configured for installation within said housing;

(c) liquid dispensing means comprising spray gun means, fluid conduit means and fluid pickup means wherein said fluid pickup means comprises a tube within said fluid container, wherein said fluid conduit means is installed within said fluid container extending from the interior of said fluid container through said second aperture within said container and cover combination to provide a passage for fluid communication from said pickup means to said spray gun means;

(d) a connection means adapted to connect with a portion of said fluid pickup tube which is passed through said second aperture to the exterior of said fluid container which is further adapted to extend through said housing aperture in said housing and to provide fluid communication from said pickup tube through said housing and through said fluid conduit; and, (e) mounting bracket means on said front wall of said housing, said bracket means adapted to removably secure said spray gun means.

2. The invention of claim 7 wherein said mounting means comprises means for mounting a roller bar and wherein said tissue dispensing means comprises a roll of tissue paper adapted for mounting to said roller bar.

* * * * *